United States Patent [19]

Hebrant

[11] Patent Number: 4,531,717

[45] Date of Patent: Jul. 30, 1985

[54] PREHEATED TROUGH FOR MOLTEN METAL TRANSFER

[75] Inventor: Georges Hebrant, Redmond, Wash.

[73] Assignee: Kaiser Aluminum & Chemical Corporation, Oakland, Calif.

[21] Appl. No.: 592,330

[22] Filed: Mar. 22, 1984

[51] Int. Cl.[3] ..... F27B 19/00

[52] U.S. Cl. ..... 266/166; 266/196; 266/231; 266/236

[58] Field of Search ..... 266/166, 196, 231, 236

[56] References Cited

U.S. PATENT DOCUMENTS

| | | | |
|---|---|---|---|
| 3,525,506 | 8/1970 | Harry, Jr. et al. | 266/196 |
| 3,863,907 | 2/1975 | Pierson, Sr. et al. | 266/236 |
| 4,355,788 | 10/1982 | La Bate | 266/196 |

*Primary Examiner*—L. Dewayne Rutledge
*Assistant Examiner*—S. Kastler
*Attorney, Agent, or Firm*—Malcolm McQuarrie

[57] ABSTRACT

A covered trough for conveying molten metal, wherein the trough includes a channel of refractory material within a metal shell, and the cover includes a layer of refractory insulation to reduce heat loss and means for preheating the trough such as a gas-fired radiant heater. Adjacent trough modules are joined together in an abutting end-to-end fashion, so that metal may flow between modules, by resilient joining means which elongate or contract to absorb differences in thermal expansion between parts of each trough module, to avoid the build up of large thermal stresses which might cause premature failure of the refractory parts.

4 Claims, 5 Drawing Figures

PREHEATED TROUGH FOR MOLTEN METAL TRANSFER

BACKGROUND OF THE INVENTION

This invention relates generally to metal transfer, and, more particularly, to a segmented trough for conveying molten metal.

Industrial plants such as mills, foundries, or casting houses which utilize molten metal must often transfer large amounts of molten metal from one location to another. As an example, molten metal may be supplied to a central casting facility from several different melting or refining furnaces, which, because of space limitations, may be placed some distance from the casting facility. Molten metal must therefore be transferred from the melting furnaces to the casting unit.

One approach to moving molten metal is the use of ladles or transfer cars into which all or part of the molten metal in the furnace is loaded as a batch, and then moved to the place where the molten metal is needed. Such batch transfer arrangements are ordinarily used where the molten metal is to be transferred a long distance such as many hundreds of feet. The batch transfer methods are not convenient where the metal is to be transferred a shorter distance, where the metal is needed in a congested location, or where the metal is to be supplied at a low flow rate over an extended period of time. In these latter circumstances, metal may be conveniently transferred relatively short distances using a transfer trough.

As an example of the desired use of transfer troughs, in an aluminum continuous casting operation aluminum alloys may be melted in several melting furnaces, and the metal conducted to a holding furnace by a transfer trough for mixing and temperature equilibration. From the holding furnace, the metal is further transferred to a continuous casting unit such as a Properzi bar casting wheel. In such applications, the rate of metal flow is very low, as on the order of 300 pounds per minute. For comparison, in other operations the metal flow rate may be thousands of pounds per minute. The low metal flow rates require that little heat be lost per foot of trough length. Also, the Properzi wheel may be continuously operated for 30 or more hours, which requires that the trough have excellent long term stability.

A molten metal transfer trough typically includes a channel for conducting the molten metal, formed from a refractory material which is not wetted by the molten metal and withstands the high heat of the metal. The refractory has a low heat transfer coefficient to minimize the heat loss by conduction as the molten metal passes along the trough. Because such refractories are generally rather brittle, the refractory must be supported within a steel bottom shell or frame which also has provision for attaching adjacent portions of the trough together.

The trough is sometimes provided with a cover to reduce the heat loss by radiation from the molten metal and also to minimize oxidation of the molten metal as it passes along the trough. A cover for a molten metal transfer trough may be as simple as a block of refractory laid on top of the trough and covering the channel, or may be more complex such as a refractory layer mounted in and supported by a metal cover shell, which cover shell may be hinged to the bottom shell for convenience in opening the top. Another desirable feature is to provide the cover with a heater to preheat the trough before metal is passed along the trough, thereby reducing or eliminating any freezing of the first molten metal to pass down a cold trough.

While molten metal troughs of the type described are often satisfactory in conveying molten metal from one place to another, they suffer from serious problems arising from the differences in thermal expansion coefficients of materials as they are heated and cooled. The problems are particularly troublesome for troughs used for extended periods of time. Most materials expand in length and volume when heated, and contract upon cooling. Different materials expand and contract at different rates. The rates may be measured and are known for most common materials. Refractory materials such as those used in the trough channel have relatively small coefficients of thermal expansion, while the steel used in the shells has a relatively large coefficient of thermal expansion. As molten metal passes along the trough, the different heating rates, temperature rises, and coefficients of thermal expansion of the various components of the trough result in differential strains and stresses within the trough. When the differential strains and stresses are sufficiently large, they cause the formation of cracks in the brittle refractory material and the leakage of molten metal to the steel shell. Ultimately, the steel shell may melt so that the entire trough fails.

The coefficients of thermal expansion of materials are fixed. Although a great deal of research has been devoted towards improved refractory materials having increased resistance to failure under thermal cycling conditions, no material has been discovered having the necessary properties and also having a sufficiently low cost to justify its use in mill applications. Thus, while improvements in the materials themselves are possible, no generally satisfactory material system has been found to allow the use of conventional troughs in many operations.

In another approach, water cooling tubes or jackets have been applied to the outside of the steel shell of the trough to keep the steel cool, thereby reducing the possibility of catastrophic failure. This trough construction is unsatisfactory, because water is brought near to the molten metal. If in an accident the molten metal should contact the water to form steam, there may be a violent explosion of metal. Also, using water cooling on the outside of the trough accelerates total heat loss, so that the trough cannot be used to convey very low flow rates of metal, over long distances.

No one seems to have previously recognized the nature of the differential expansion problem, and particularly its significance for troughs to be used in low metal flow, long time operations. No satisfactory metal transfer trough has therefore been devised for use in such operations.

Accordingly, there has been a need for an improved molten metal transfer trough having the desirable qualities of previously existing troughs, but also having reduced susceptibility to material damage or leakage of molten metal resulting from the effects of differential thermal expansion of the components. Such a trough should have a very low rate of heat loss per foot of length and be stable for use in long continuous operation. The present invention fulfills this need, and further provides related advantages.

SUMMARY OF THE INVENTION

The present invention is embodied in a modular trough for transferring molten metal, wherein the trough modules are joined so as to minimize the deleterious effects of stresses and strains induced by thermal expansion differences of the components. The cover of the trough is insulated by refractory material, and is provided with a heater so that the trough may be preheated before molten metal is introduced. The modular trough of the invention exhibits improved resistance to the damage of the refractory and leakage of molten metal, thereby achieving a longer useful life and lower cost than prior troughs.

In accordance with the invention, a modular trough for conveying molten metal comprises multiple trough modules having refractory channels therein, each module including a refractory channel within a metal shell, and further includes resilient joining means for compressively forcing adjacent modules together in an abutting end-to-end relationship so that metal may flow continuously between the channels of the adjacent modules. The joining means includes loading means for resiliently applying a force, and reaction means for reacting this force through the channels to compressively force the ends of the adjacent channels together. The joining means thus holds the ends of the channels together compressively so that a tight joint is maintained to conduct the molten metal, yet also resiliently changes length to prevent excessively high thermal strains and stresses which might overload and cause damage to the channels. That is, the resilient joining means absorbs a large portion of the length changes caused by differential thermal expansion induced during the heating and cooling of the trough, by changing in length while simultaneously maintaining a compressive loading on the abutting trough channels, so that the frequency materials are not subjected to unduly high stresses or strains which might cause premature failure or leakage of molten metal.

More specifically, in a preferred embodiment of the invention each trough module includes a trough bottom having an insulated refractory lining shaped as a channel for conveying molten metal longitudinally along the trough bottom, and is enclosed within a metallic bottom shell or frame which supports the refractory lining. A trough cover includes a layer of refractory insulation supported by a trough cover shell, and an interior heater for preheating the trough bottom prior to the introduction of the molten metal. Preferably, the trough heater is a gas-fired radiant heater. The trough cover shell is hingedly joined to the bottom shell so that the cover may be conveniently opened on its hinges to reveal the interior of the trough bottom for inspection and cleaning, although in normal use the cover is closed.

In this preferred embodiment the trough modules are joined by resilient joining means for longitudinally joining the bottom shells of adjacent modules in an abutting end-to-end fashion. The bottom shell modules are provided with a bolted flange at either end having a bolt hole pattern that registers with the pattern on the flange of the abutting module. The resilient joining means is preferably a plurality of bolts and associated nuts for fastening the modules at the abutting flanges, with two pairs of Belleville washers used to provide a compressive, resilient biasing force at each bolt. This preferred joining means is assembled by first slipping a pair of Belleville washers onto the bolt, passing the bolt through a registered opening of the bolt patterns of the two abutting flanges, placing the other pair of Belleville washers onto the bolt, and finally threading on a nut. The nut is then tightened to achieve a desirable compressive preloading. Preferably, a gasket formed of refractory fibers is placed between the abutting ends of the refractory channel of each module prior to attaching the modules together with bolts and Belleville washers, as previously described. The resiliency provided by the joining means absorbs thermal expansion strains resulting from the differences in thermal expansion and heat loading of the refractory channel and the trough bottom shell, thereby reducing the magnitude of any thermal strains and stresses in the refractory. The preloading of the joining means, together with the gasket, ensures retention of a seal between the refractory channels so that molten metal does not leak.

It will be appreciated from the foregoing that the present invention represents an advance in the field of transferring molten metal through the use of troughs. The trough may be preheated to minimize the possibility of solidification of the first molten metal which is introduced into the trough during each use. With the insulation system provided, the heat loss from the stream of molten metal passing along the trough is very small, so that the superheating of the metal to account for such heat loss can be small. In turn, the usable trough length is increased, or, alternatively, the temperature which must be maintained in the furnace that delivers the molten metal is reduced, resulting in energy savings. The resilient joining means for joining adjacent modules of the trough ensures a tight seal between the refractory channels carrying the molten metal, and also reduces the amount of thermal strain and stress in the refractory channel, in turn reducing damage induced by differential thermal expansion. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
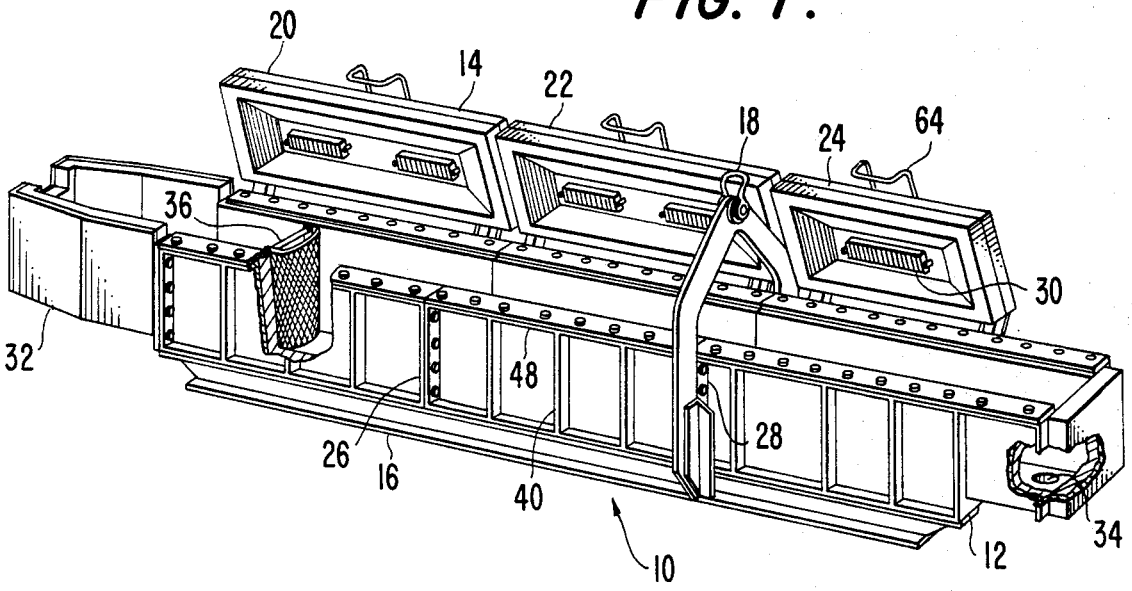
FIG. 1 is a perspective view of a three module trough in accordance with the present invention, with the hinged covers open and with portions of the trough broken away to illustrate features.

As is shown in the drawings, the present invention is preferably embodied in a trough 10 for transferring molten metal from a source to a delivery point. Referring to FIG. 1, the trough 10 includes a trough bottom 12 through which the molten metal flows and a trough cover 14 which covers the trough bottom 12. The trough 10 may be mounted in a support 16 formed of welded structural members and provided with a lifting shackle 18, whereby the trough 10 may be readily moved and positioned.

The trough 10 is formed of two or more trough modules. As will be described in greater detail, the use of multiple modules allows convenient fabrication of the components of the trough and also promotes the reduction or elimination of stresses induced by differences in thermal expansion coefficients, through the means by which the modules are joined together. Modules may be fabricated in standard lengths and for the purpose of performing specified functions, and then joined together to achieve the desired length of the trough. The trough 10 illustrated in FIG. 1 comprises three segments 20, 22, and 24. The segments are joined together at flanges 26 and 28.

The covers 14 are provided with heaters 30 to preheat the interior of the trough 10 prior to the introduction of liquid metal. If the trough 10 were not preheated in this fashion, the first liquid metal to enter the trough would solidify and partially or completely block the trough 10. In the illustrated embodiment, the trough 10 is provided with a metal receiver 32 for connecting the trough 10 to a source of liquid metal (not shown) such as a furnace or metal mixer. The molten metal flows through the trough 10 to a delivery hole 34 at the opposite end from the metal receiver 32. The passage of the molten metal may be unobstructed, or there may be optionally provided a filtering means such as a glass fiber filter 36 placed in the stream so as to filter particles, oxide, and slag from the metal. The glass filter 36 is readily inspected and replaced at periodic intervals by opening the cover 14 and lifting out the frame upon which the glass filter 36 is mounted.

Figure 2:
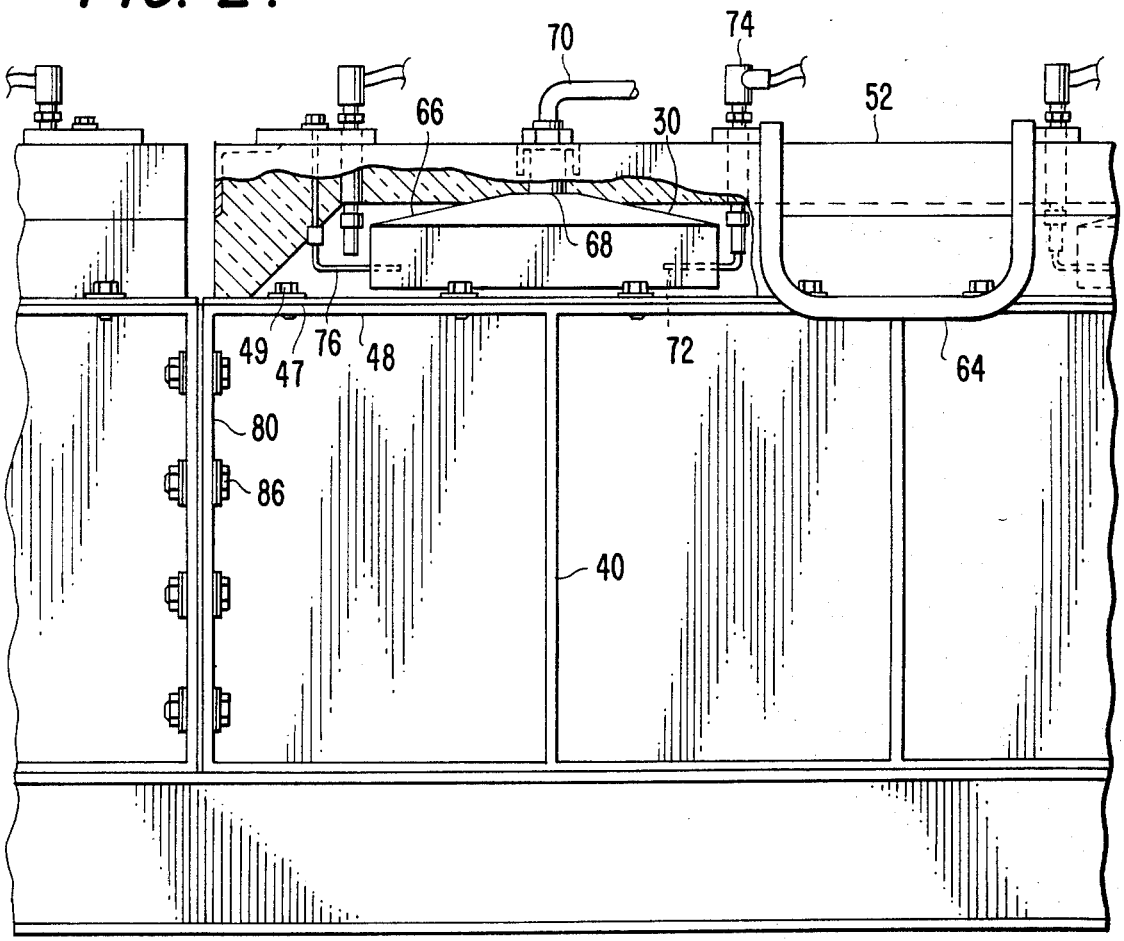
FIG. 2 is an enlarged, side, partly sectional view of a portion of two adjacent trough modules of FIG. 1, except with the cover closed.
Figure 3:
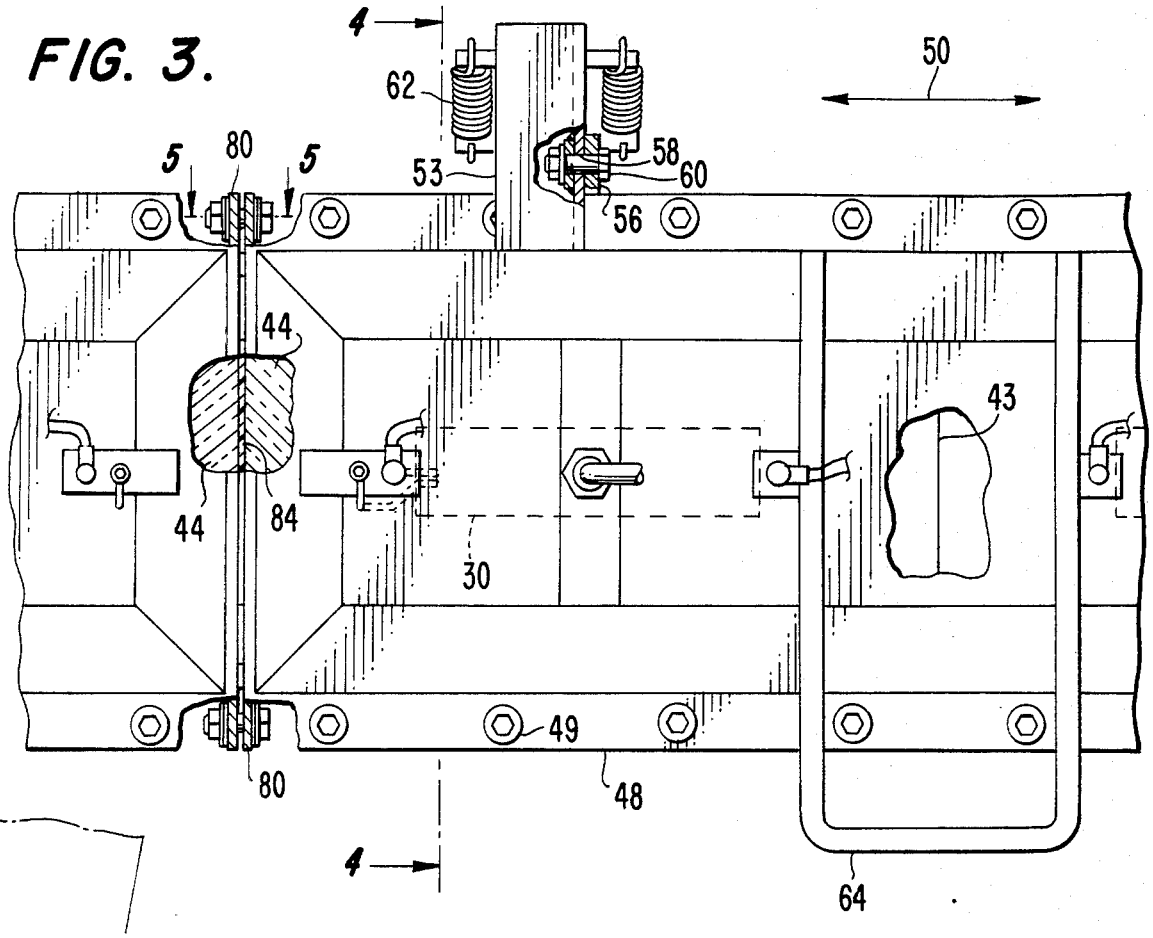
FIG. 3 is an enlarged top view of the trough of FIGS. 1 and 2 with some portions of the trough broken away to illustrate features.
Figure 4:
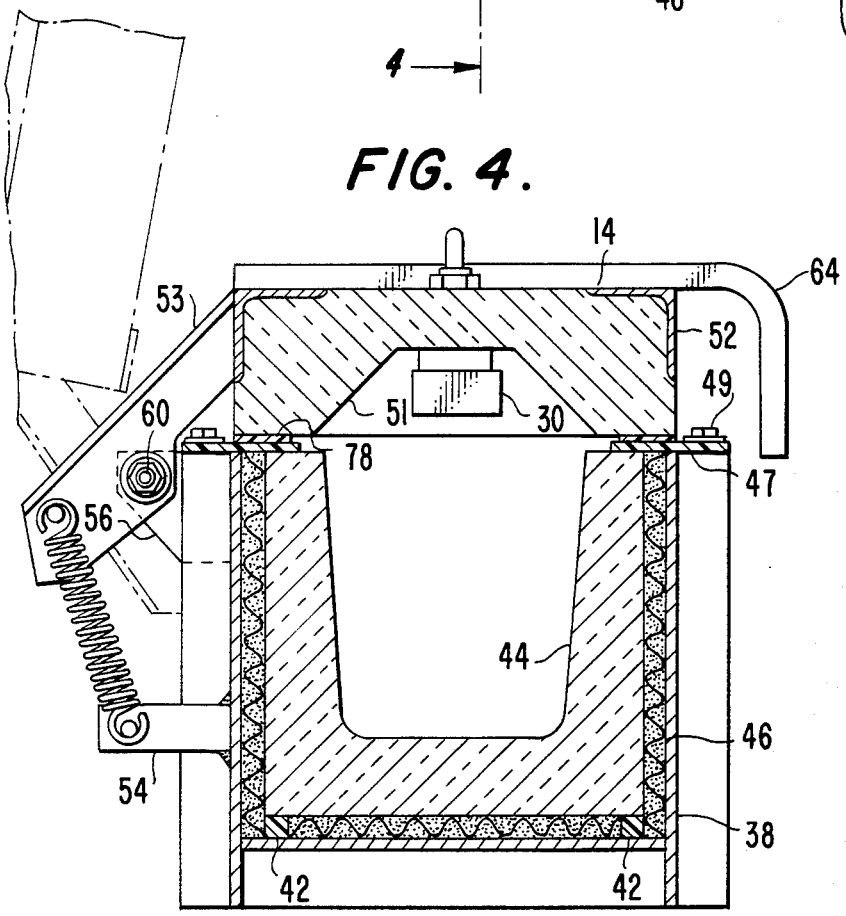
FIG. 4 is an enlarged end sectional view of the trough, taken generally along lines 4—4 of FIG. 3.

Further details of the trough 10 are illustrated in FIGS. 2–4, wherein the cover 14 is illustrated in the closed position.

FIG. 4 illustrates the cross-sectional construction of the trough 10. The trough bottom 12 includes a generally U-shaped steel frame 38 having longitudinally spaced stiffener ribs 40 for increased rigidity of the frame 38. Supported within the frame 38 is a generally U-shaped refractory channel 44 through which the molten metal flows. The refractory channel 44 sits upon and is supported by an insulation board set 46. The insulation board set 46 in turn rests upon the steel frame 38. The frame 38 constitutes a shell which receives and encloses the channel 44 and the board set 46.

The refractory channel 44 and insulation board set 46 are held in the frame 38 by a clamp-down bar 47, which extends across the tops of the channel 44 and board set 46. The clamp-down bar 47 is attached to a top flange 48 of the frame 38 by a series of clamp-down bolts 49. A clamp-down 47 is provided on each side of the channel 44. When the trough module is assembled in the manner hereinafter described, the clamp-down bars 47 hold the channel 44 to the frame 38, with a longitudinal compressive loading maintained in the channel 44. The clamp-down bar 47 also mechanically positions the channel 44 while allowing it to slide small amounts relative to the frame 38 along a longitudinal axis 50 of the trough 10 under the influence of thermal expansion.

The channel 44 is assembled to the frame 38 with a longitudinal compressive preload in the channel 44, and with the channel 44 protruding longitudinally from each end of the frame 38. In a preferred embodiment, the channel 44 is 48 inches long, and is made by placing end-to-end two channel tile segments each 24 inches long. The adjoining end of the two segments are coated with a refractory sealant and longitudinally compressed together in a jig (not shown). The steel frame 38, which is $47\frac{7}{8}$ inches long, is placed over the channel 44 with the board set 46 between the channel 44 and the frame 38. The clamp-down bars 47 are placed over the top of the channel 44 and board set 46, and the clamp down bolts 49 tightened with the longitudinal compressive preload maintained on the channel 44. The preload is released, but the longitudinal compressive load in the channel 44 is maintained by the clamp-down bars 47. Both ends of the channel 44 longitudinally protrude about 1/16 inch from the steel frame 38.

The cover 14 includes a refractory insulation layer 51 having the cross-sectional shape of a shallow inverted "U" with diverging interior walls, thereby forming a recess in the insulation layer 51. The refractory insulation layer 51 is mounted to and supported by a steel cover frame 52.

An upper hinge arm 53 is welded to the steel cover frame 52, and a lower hinge arm 54 is welded to the bottom steel frame 38. A pair of pivot plates 56 are welded to the upper portion of the bottom steel frame 38, the pivot plates 56 having a hinge pivot bore 58 therethrough parallel to the longitudinal axis 50 of the trough 10. The hinge pivot bore 58 receives a pivot pin 60 passing through the pivot bore 58 and through a corresponding bore in the upper hinge arm 53, to form a hinge whereby the cover 14 may be pivoted upwardly to allow access to the interior of the trough 10. To reduce the force required to pivot the cover 14 about the pivot pin 60, a hinge spring 62 extends from the moveable upper hinge arm 53 to the stationary lower hinge arm 54. Attached to the cover frame 52 is a handle 64 whereby the cover 14 may be pivoted about the pivot pin 60 with the assistance of the hinge portion spring 62 to gain access to the interior of the trough 10. (The phantom lines in FIG. 4 illustrate the cover in its open position.)

The heater 30 is attached within the recessed portion of the refractory insulation layer 51 of the cover 14. The heater 30 is activated in a preheating function prior to the introduction of molten metal, to preheat the interior of the refractory channel 44 to a temperature sufficiently great that the first molten metal introduced into the channel 44 is not so cooled that it freezes in the channel 44 or the delivery hole 34.

The heater 30 may be of any convenient construction, and the preferred construction utilizes a gas-fired radiant heater. As illustrated in FIG. 2, the preferred heater 30 includes a ceramic block 66 having a burner nozzle 68. Natural gas is supplied to the burner nozzle 68 through a gas line 70. The gas flowing through the burner nozzle 68 is ignited by an electrical igniter 72, energized by the electrical potential between an electrode 74 and a ground 76. The flame produced by burning the gas is not directed downwardly against the refractory channel 44, as this would tend to locally heat a small area of the channel 44 and induce thermal cracking. Instead, the flame is directed generally along the surface of the ceramic block 66 to heat the ceramic block 66, which in turn generally uniformly heats the refractory channel 44 by radiation. In normal operation, the heater 30 is operated prior to introduction of the molten metal into the trough 10, but in some instances the heater 30 may be operated with molten metal in the trough 10 to increase the temperature of the metal in the trough 10. Additionally, the burning natural gas creates a reducing atmosphere, which inhibits oxidation of the molten metal in the trough 10 and may reduce any oxides already present on the molten metal. In its closed position, the cover 14 rests on a cover gasket 78 made of a fibrous refractory material which serves to insulate against heat losses between the cover 14 and the bottom 12 and also acts to maintain the partial pressure of reducing gas in the interior of the trough 10 during passage of the molten metal.

When the refractory channel 44 is preheated prior to introduction of the molten metal into the trough 10, and during the period that molten metal is present in the trough 10, the refractory channel 44 is heated to a temperature considerably greater than that of the steel frame 38. Consequently, the refractory channel 44 increases in length parallel to the longitudinal axis 50 of the trough 10 to a different extent than does the steel frame 38. The total difference in elongation may be approximated as an average coefficient of linear expansion of the refractory channel 44 times its increase in temperature, less an average coefficient of linear expansion of the steel frame 38 times its increase in temperature, with this quantity multipled by the length of the trough module 20, 22, or 24. It is important to maintain longitudinal continuity of the refractory channels 44 from module to module, so that molten metal cannot leak through a gap created between the refractory channels of adjacent modules. At the same time, it is important that the thermal strains resulting from the thermal expansion differences are not so great as to cause failure and cracking of the refractory channel 44, which is formed of a material normally having a low ductility and resistance to cracking.

Figure 5:
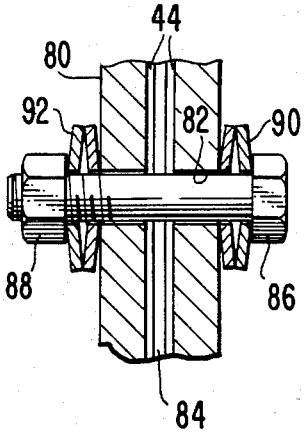
FIG. 5 is a further enlarged detail view of the preferred resilient joining means, taken generally along line 5—5 of FIG. 3.

In accordance with the invention, adjacent trough modules are joined together by resilient joining means for compressively forcing the refractory channels 44 of adjacent modules together in an abutting end-to-end relationship, while simultaneously providing mechanical resiliency to absorb the thermal strains created by the differences in the thermal expansion between the steel frame 38 and the refractory channel 44. As illustrated in FIG. 5 for the preferred embodiment, the steel frame 38 is provided at each end with an end flange 80 having provision for a standard bolt pattern of bolt holes 82 so that the bolt holes of adjacent trough modules may be brought into registry. An end gasket 84 coated with a refractory sealant and having a shape corresponding to the cross-sectional shape of the refractory channel 44 is placed between the abutting end of the adjacent refractory channels 44, to cushion their contact, act as a seal against the leakage of molten metal through the joint between the adjacent refractory channels 44, and as a portion of the resilient joining means.

The adjoining flanges 80 are joined by a plurality of externally threaded bolts 86 extending through the abutting end flanges 80 and secured by an internally threaded nut 88. A first pair of Belleville washers 90 is placed between the head of the bolt 86 and its nearest end flange 80, and another pair of Belleville washers 92 is placed between the nut 88 and its nearest end flange 80. The nut 88 is then tightened to axially preload the bolt, preferably to about 15 foot-pounds of torque. If multiple modules are to be joined, it is preferable to assemble all the modules with 10 foot-pounds of torque, before a final tightening to 15 foot pounds. The pairs of Belleville washers 90 and 92 are compressed so as to retain the end gasket 84 in compression at all times, regardless of length changes that are introduced by the differential thermal expansion effect described previously.

In practice, it has been found that for a trough segment of about 48 inches in length and carrying molten aluminum at a temperature of about 1350° F., the maximum differential length change is about 0.050 inches. The bolts 86 are ½ inch by 2 inch steel hex-head bolts. The Belleville washers are chosen so that the total length change obtainable by loading the two pairs of Belleville washers is sufficiently great to accommodate the differential thermal expansion length change. Specifically, in these conditions it has been found that the dish depth of each of the four Belleville washers should be at least 0.020 inches. With this dish depth, each bolt may be preloaded to the desired preloading and the Belleville washers can further deform to resiliently absorb the thermal expansion and contraction differences so that the compressive preloading on the abutting ends of the refractory channels 44 is maintained throughout the heating and cooling cycle. Consequently, the end gasket 84 is maintained in compression as an effective seal against any loss of molten metal at the joint between the abutting refractory channels 44.

The exact materials selected for the construction of the trough are not critical, although they must withstand the thermal and mechanical loadings imposed. The channel 44 is formed of a nonmetallic refractory having a low expansion coefficient, low conductivity, and acceptable elevated-temperature mechanical properties. The preferred embodiment of the invention is used to convey molten aluminum. In that application the preferred refractory is an asbestos-free blend of alumina-silica fibers bonded together with an organic bonding system, having a density of about 65 pounds per cubic foot, which is not wetted by aluminum. Such a refractory is marketed as Pyroform-PC by Rex Roto Corporation, Fowlerville, Mich. The material of the board set is ¾ inch thick, is manufactured from the same refractory material as the channel, except that the density is about 18 pounds per cubic foot, and is available as Pyroboard from Rex Roto Corporation. The sealant used to coat the end gasket 84 and between portions of the channel 44 is a paste containing alumina-silica fibers with an organic bonding system, which sets at ambient temperature but may be heated to drive off minor amounts of moisture. This sealant is marketed as Pyroform-PC extender by Rex Roto Corporation. The cover gasket 78 and the end gasket 84 are preferably formed from a more flexible refractory material such as woven silica fibers not bound together into a rigid shape. Such a material is commercially available under the name Fiberfrax 970J from the Carborundum Co. Other aspects of construction will be recognized as conventional by those skille in the art.

It will now be appreciated that, through the use of the trough of the present invention, molten metal may be transferred from a supply point to a delivery point conveniently. The trough may be preheated to avoid freezing of the molten metal first entering the trough. Additionally, in the preferred embodiment the temperature drop is only about 0.30° F.–0.50° F. per linear foot of length at a flow rate of 300 pounds per minute of molten aluminum. This low temperature drop saves significantly on the energy required to heat the molten metal. Further, the life of the trough is greatly prolonged by the resilient joining means for joining adjacent trough modules to absorb thermal expansion differences introduced as a result of differential thermal expansion between components. With the resilient joining means, the abutting ends of the refractory channels of adjacent modules are held in compression with an interposed refractory gasket to prevent leakage of molten metal through the crack between the abutting refractory linings. Additionally, the resilient joining means reduces the magnitude of thermal strains which can cause cracking of the brittle refractory lining, thereby increasing its useful operating life.

Test troughs of total length of about 80 feet have been constructed in accordance with the present invention. The trough is preheated to about 500° F., and there is no freezing of molten aluminum introduced at about 1350° F., as it flows the length of the trough. The temperature on the outside of the steel shell is measured as about 150°-165° F., which is not so hot that operators are injured if they briefly come in contact with the sides of the trough. It is found that, because of the low heat loss from the trough, molten aluminum may be conveyed at low flow rates, over long distances. The reduction of thermal strains through the resilient joining means allows long duration runs of 24 hours or more, with an acceptably low level of thermally induced damage. This combination of low heat loss and long life allows the elimination of holding furnaces between the melting furnaces and the casting unit, thereby effecting major cost and energy savings. Finally, the trough has a compact, neat appearance and construction which is convenient to maintain.

Although a particular embodiment of the invention has been described in detail for purposes of illustration, various modifications may be made without departing from the spirit and scope of the invention. Accordingly, the invention is not to be limited except as by the appended claims.

I claim:

1. A segmented trough for conveying molten metal, comprising: (a) a first channel of a refractory material; (b) a second channel of a refractory material; and (c) joining means for compressively forcing said first and second channels together in an abutting end-to-end relationship so that molten metal may flow continuously from said first channel into said second channel, said joining means including loading means for resiliently applying a force and reaction means for reacting the force produced by said loading means through said channels to produce a compressive force forcing the ends of such channels together, said reaction means including two metal frames, one supporting each of said channels, and said loading means including biasing means for compressively forcing the abutting ends of said frames together, the longitudinal length of each of said channels being greater than the longitudinal length of the respective frame in which it is supported, so that the ends of said channel protrude beyond the ends of said frame, whereby said joining means resiliently responds to changes in the length of said channels caused by thermal expansion so that the channels are not overloaded by thermal stresses, yet maintains a compressive force holding the ends of said channels together so that molten metal cannot leak from the joints between said channels.

2. The trough of claim 1, further including a gasket placed between the abutting ends of said channels to prevent leakage of molten metal between the abutting ends.

3. The trough of claim 1, wherein each frame includes a flange on an end thereof, and said flanges are joined by said loading means.

4. The trough of claim 3, wherein said loading means is a plurality of bolts each carrying at least one pair of Belleville washers to compressively force said flanges together.

* * * * *